US010941631B2

(12) United States Patent
Harbi et al.

(10) Patent No.: US 10,941,631 B2
(45) Date of Patent: Mar. 9, 2021

(54) CEMENTING PLUG SYSTEM

(71) Applicant: Saudi Arabian Oil Company, Dhahran (SA)

(72) Inventors: Atallah N. Harbi, Dammam (SA); Ziyad Alsahlawi, Dhahran (SA); Ossama R. Sehsah, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 45 days.

(21) Appl. No.: 16/285,436

(22) Filed: Feb. 26, 2019

(65) Prior Publication Data

US 2020/0270964 A1 Aug. 27, 2020

(51) Int. Cl.
*E21B 33/16* (2006.01)
*E21B 47/06* (2012.01)

(52) U.S. Cl.
CPC ..... *E21B 33/16* (2013.01); *E21B 47/06* (2013.01)

(58) Field of Classification Search
CPC ..... E21B 33/1208; E21B 33/13; E21B 33/14; E21B 33/16; E21B 47/005; E21B 47/06; E21B 47/117; E21B 37/045
See application file for complete search history.

(56) References Cited

U.S. PATENT DOCUMENTS 1,677,975 A * 7/1928 McKee ..... E21B 33/16 166/291
2,253,536 A * 8/1941 Domer ..... E21B 33/16 166/64
2,253,537 A * 8/1941 Domer ..... E21B 33/16 166/64
2,560,692 A * 7/1951 Hall ..... E21B 33/16 166/156
2,560,901 A * 7/1951 Smith ..... E21B 33/16 166/155
3,437,137 A * 4/1969 Scott ..... E21B 33/16 166/153

(Continued)

FOREIGN PATENT DOCUMENTS

GB 2242215 A 9/1991
WO WO-2015047259 A1 * 4/2015 ..... E21B 21/08

OTHER PUBLICATIONS

International Search Report for PCT/IB2019/052456, 7 pages (dated Dec. 17, 2019).

(Continued)

*Primary Examiner* — Jennifer H Gay
(74) *Attorney, Agent, or Firm* — Choate, Hall & Stewart LLP; Charles E. Lyon; Peter Flynn

(57) ABSTRACT

An example system for isolating cement slurry from drilling fluids includes a tool configured for installation on a landing collar of a casing. The tool includes a base that conforms to an inner circumference of the casing and a tube that extends uphole from the base. The tube has a first borehole that extends downhole through the base. The tube is perforated to allow cement slurry to pass from the casing into the first borehole. A cementing plug is configured to seal to the casing uphole of the base. The cementing plug includes a second borehole to receive the tube. The cementing plug includes a covering that extends across at least part of the borehole and that is configured to break in response to contact with the tube.

18 Claims, 11 Drawing Sheets

(56) References Cited

U.S. PATENT DOCUMENTS

| | | | | |
|---|---|---|---|---|
| 5,095,980 | A * | 3/1992 | Watson | E21B 29/00 166/153 |
| 5,246,069 | A * | 9/1993 | Glaser | E21B 17/14 166/153 |
| 5,433,270 | A | 7/1995 | LaFleur | |
| 6,634,425 | B2 | 10/2003 | King et al. | |
| 6,945,326 | B2 | 9/2005 | Mikolajczyk | |
| 9,556,701 | B2 | 1/2017 | Stair | |
| 9,689,230 | B2 | 6/2017 | Andrigo | |
| 9,708,904 | B2 * | 7/2017 | McGarian | E21B 47/117 |
| 9,719,322 | B2 | 8/2017 | Goebel | |
| 2004/0065435 | A1 * | 4/2004 | Tessier | E21B 33/16 166/153 |
| 2008/0272931 | A1 * | 11/2008 | Auzerais | E21B 47/135 340/854.7 |
| 2011/0192593 | A1 | 8/2011 | Roddy et al. | |
| 2013/0112434 | A1 * | 5/2013 | Lende | E21B 17/06 166/386 |
| 2013/0118752 | A1 * | 5/2013 | Hannegan | E21B 33/143 166/336 |
| 2014/0034301 | A1 | 2/2014 | Leblanc | |
| 2014/0102723 | A1 | 4/2014 | Stair | |
| 2014/0131101 | A1 * | 5/2014 | Coley | E21B 47/08 175/45 |
| 2014/0138097 | A1 | 5/2014 | Andrigo | |
| 2014/0216756 | A1 * | 8/2014 | Getzlaf | E21B 34/063 166/376 |
| 2014/0338896 | A1 * | 11/2014 | McGarian | E21B 47/06 166/250.08 |
| 2016/0160601 | A1 | 6/2016 | Stair | |
| 2016/0230533 | A1 * | 8/2016 | Steele | E21B 47/12 |
| 2019/0017348 | A1 * | 1/2019 | Nanney | E21B 37/00 |
| 2019/0093472 | A1 * | 3/2019 | Dewald | E21B 37/02 |
| 2019/0323342 | A1 * | 10/2019 | Pedersen | G01M 3/20 |
| 2020/0123894 | A1 * | 4/2020 | Ross | E21B 33/12 |

OTHER PUBLICATIONS

Written Opinion for PCT/IB2019/052456, 11 pages (dated Dec. 17, 2019).

Rigzone, How Does Cementing Work?, 5 pages (Retrieved Nov. 28, 2018). URL: https://www.rigzone.com/training/insight.asp?insight_id=317.

* cited by examiner

CEMENTING PLUG SYSTEM

TECHNICAL FIELD

This specification relates generally to systems for isolating cement slurry from drilling fluids using cementing plugs.

BACKGROUND

During construction of an oil or gas well, a drill string having a drill bit bores through earth, rock, and other materials to form a wellbore. The drilling process includes, among other things, pumping drilling fluid down into the wellbore and receiving return fluid and materials from the wellbore at the surface. In order for the well to become a production well, the well must be completed. Part of the well construction process includes incorporating casing into the wellbore. Casing supports the sides of the wellbore and protects components of the well from outside contaminants. The casing may be cemented in place and the cement may be allowed to harden to hold the casing in place. A process for applying the cement to the casing may be referred to as cementing.

SUMMARY

An example system for isolating cement slurry from drilling fluids includes a tool configured for installation on a landing collar of a casing. The tool includes a base that conforms to an inner circumference of the casing and a tube that extends uphole from the base. The tube has a first borehole that extends downhole through the base. The tube is perforated to allow cement slurry to pass from the casing into the first borehole. A cementing plug is configured to seal to the casing uphole of the base. The cementing plug includes a second borehole to receive the tube. The cementing plug includes a covering that extends across at least part of the borehole and that is configured to break in response to contact with the tube. The example system may include one or more of the following features, either alone in combination.

The cementing plug may include fins on an exterior surface of the cementing plug. The fins may be for contacting the inner circumference of the casing to seal the cementing plug to the casing. The cementing plug may have a bottom face that contacts the base. The bottom face may have a coarse surface to increase an amount of friction between the cementing plug and the base. The bottom face may have teeth to increase an amount of friction between the cementing plug and the base. The cementing plug may be a first cementing plug and the system may include a second cementing plug configured to seal to the casing uphole of the first cementing plug. The second cementing plug may have a same configuration as the first cementing plug. The cementing plug may include an elastomer or aluminum. The covering may be configured to break also in response to hydraulic pressure within a range of 500 pounds-per-square-inch (PSI) (3447.38 kilopascals (kPa) to 10,000 PSI (68,974.57 kPa).

The first borehole may have a shape of a funnel. A first part of the borehole adjacent to holes in the tube may correspond to a narrow part of the funnel. A second part of the borehole that is downhole of the first part of the borehole may correspond to a wide part of the funnel.

The tube may be longer than the cementing plug such that the tube extends through the cementing plug and beyond the cementing plug when the cementing plug is in contact with the base. The tube may have a pointed tip for breaking the covering. The covering may include one of aluminum or ceramic. The tool may include aluminum, lead, or a combination of aluminum and lead.

The system may include pressure sensors. The pressure sensors may include a first pressure sensor located uphole of at least part of the tool and a second pressure sensor located downhole of the tool. The system may include a control system to obtain data from the pressure sensors and to process the data to determine when the covering breaks. The control system may be configured to process the data to determine if a seal formed by the cementing plug has been compromised.

An example system for isolating cement slurry from drilling fluids includes a tube secured within a casing of a wellbore. The tube has a borehole. A cementing plug is movable within the casing to contact the tube and to create a seal to the casing. The contact causes the tube to penetrate the cementing plug to enable cement slurry to move through the borehole past the cementing plug. The system includes pressure sensors. The pressure sensors include a first pressure sensor located uphole of the tool and a second pressure sensor located downhole of the tool. The first pressure sensor is for outputting first data based on a pressure uphole of the cementing plug. The second pressure sensor is for outputting second data based on a pressure downhole of the cementing plug. A control system is configured to process the first data and the second data to obtain information about a cementing operation performed using the tube and the cementing plug. The example system may include one or more of the following features, either alone in combination.

The information may indicate whether the cement slurry is contaminated or in a solid state. The information may relate to a sealing integrity of the cementing plug to the casing. The cementing plug may include a disk configured to break in response to contact with the tube. The cementing plug may be a first cementing plug and the system may include a second cementing plug configured to seal to the casing uphole of the first cementing plug. The second cementing plug may have a same configuration as the first cementing plug. The tube may include sets of holes along a circumference of the tube at various locations along a length of the tube.

An example process for isolating cement slurry from drilling fluids includes inserting a first cementing plug into the casing. The first cementing plug has a covering that breaks in response to contact. The method includes forcing cement slurry into the casing. A force of the cement slurry against the first cementing plug moves the cementing plug into contact with a needle-shaped tube located within the casing. The contact between the first cementing plug and the needle-shaped tube causes the covering to break thereby allowing the cement slurry to move downhole past the first cementing plug via the needle-shaped tube. The method includes inserting a second cementing plug into the casing uphole of the cement slurry and forcing the second cementing plug downhole and into contact with the first cementing plug to force at least some of the cement slurry remaining in the casing past the first cementing plug. The example method may include one or more of the following features, either alone in combination.

The first cementing plug and the second cementing plug may have identical configurations. The needle-shaped tube may include sets of holes along a circumference of the needle-shaped tube at various locations along a length of the needle-shaped tube. The cement slurry may pass through the holes. The first cementing plug and the second cementing plug each may include fins on an exterior surface. The fins may be for contacting an inner circumference of the casing to create a fluid-tight seal to the casing. The fins may scrape an inner surface of the casing as the first cementing plug and the second cementing plug move downhole.

The method may include obtaining data from pressure sensors. The pressure sensors may include a first pressure sensor above the first cementing plug and a second pressure sensor below the first cementing plug. The data may be processed to obtain information about the cementing. The information may indicate when the covering breaks. The information may relate to a sealing integrity of the cementing plug to the casing. The method may include waiting for a period of time to allow the cement slurry to harden and drilling through the first cementing plug, the second cementing plug, and the needle-shaped tube within the casing. The first cementing plug and the second cementing plug may have different configurations.

Any two or more of the features described in this specification, including in this summary section, may be combined to form implementations not specifically described in this specification.

At least part of the methods, systems, and techniques described in this specification may be controlled by executing, on one or more processing devices, instructions that are stored on one or more non-transitory machine-readable storage media. Examples of non-transitory machine-readable storage media include read-only memory, an optical disk drive, memory disk drive, and random access memory. At least part of the methods, systems, and techniques described in this specification may be controlled using a computing system comprised of one or more processing devices and memory storing instructions that are executable by the one or more processing devices to perform various control operations.

The details of one or more implementations are set forth in the accompanying drawings and the following description. Other features and advantages will be apparent from the description and drawings, and from the claims.

DESCRIPTION OF THE DRAWINGS

Like reference numerals in different figures indicate like elements.

DETAILED DESCRIPTION

Figure 1:
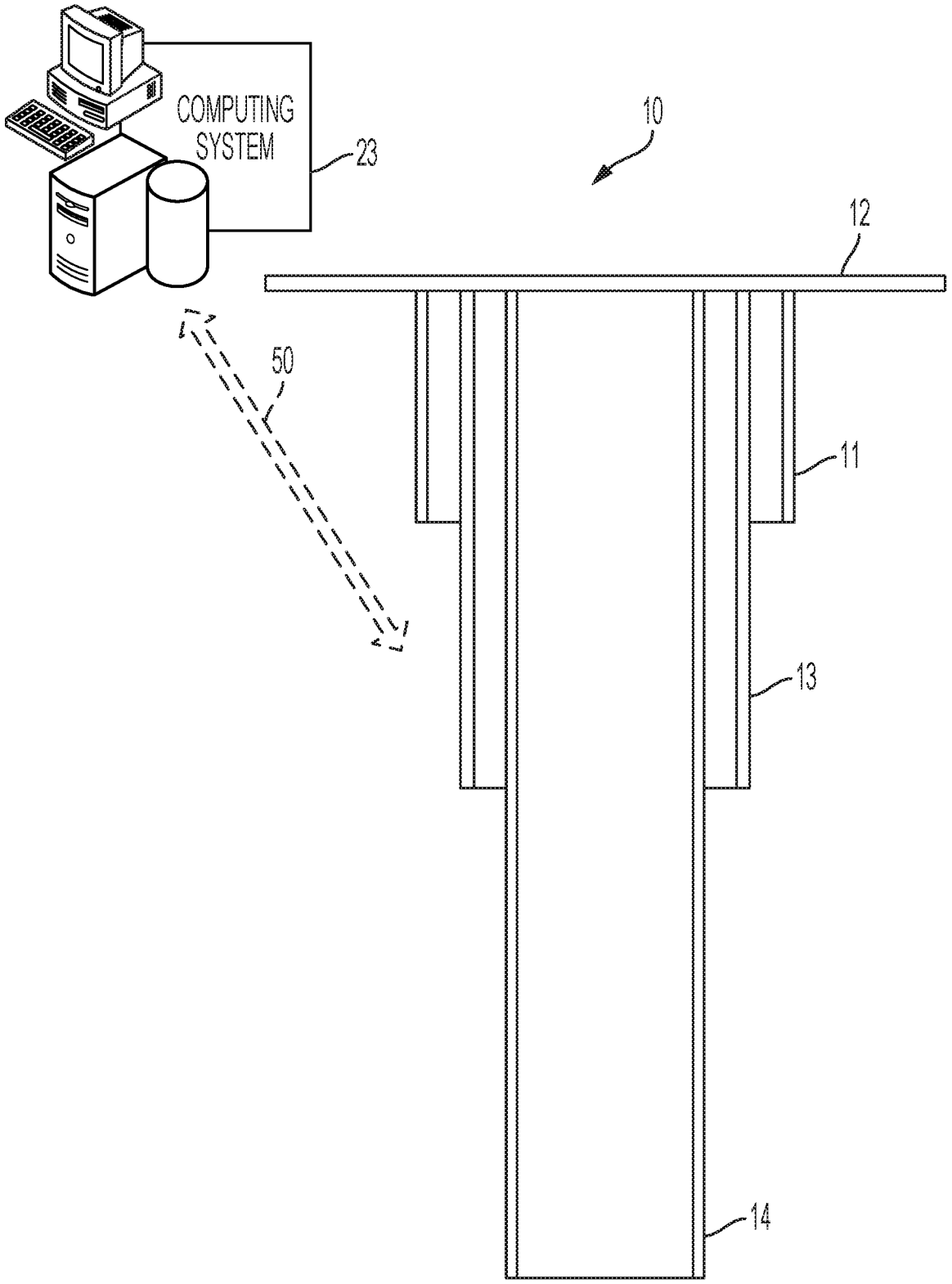
FIG. 1 is a cross-sectional block diagram of components of an example casing string for a well.

To produce a well such as an oil well or a gas well, a drill bores through earth, rock, and other materials to form a wellbore. Casing supports the sides of the wellbore. The casing may be implemented as or be part of a casing string. A casing string may include multiple nested casing segments, which each reach successively further downhole. The drilling process includes, among other things, pumping drilling fluid into the wellbore and receiving return fluid containing materials from the wellbore at the surface. In some implementations, the drilling fluid includes water- or oil-based mud and the return fluid carries mud, rock, and other materials from the wellbore to the surface. This circulation of drilling fluid into and out of the wellbore may occur throughout the drilling process.

Described in this specification are example systems for use in cementing a casing segment—or simply a "casing"—within a wellbore. In some examples, cementing includes applying cement slurry to an annulus between the casing and the wellbore or to an annulus between two adjacent casings in a casing string. The systems use cementing plugs that are configured to separate cement slurry from drilling fluids within the casing. The cementing plugs may be made of rubber or other malleable materials that can create a fluid-tight seal to the inner circumference of the casing. During a cementing operation, a first (or downhole) cementing plug is inserted into the casing. Cement slurry is then forced into the casing using one or more pumps. The downhole-directed pressure of the cement slurry forces the first cementing plug downhole until it reaches a landing collar, for example. Because the first cementing plug creates a fluid-tight seal to the inner circumference of the casing, there is little or no mixture between drilling fluid or other fluid downhole of the cementing plug and the cement slurry uphole of the cementing plug.

A tool at the landing collar includes a needle-shaped tube (or simply, "tube") having a borehole. The tube faces uphole and includes a pointed end that is configured to penetrate—for example, to shear, to break, to rupture, or to pierce—a part of the first cementing plug when the tube and the first cementing plug come into contact. The tube then extends past the cementing plug into the part of the casing containing the cement slurry. The tube is perforated in that the tube includes holes around its circumference and extending along its length. Cement slurry may be forced downhole past the first cementing plug through those holes and through an opening in the top of the tube. The fluid-tight seal of the first cementing plug continues to inhibit mixing of the drilling fluid downhole of the cementing plug and the cement slurry uphole of the cementing plug. The cement slurry forced past the cementing plug displaces the drilling fluid downhole of the cementing plug and fills at least part of the annulus between the casing and the wellbore or other casing. There, the cement slurry is left to harden over the course of hours or days.

As part of the cementing operation, a second (or uphole) cementing plug is inserted into the wellbore uphole from any cement slurry remaining in the casing. In this example, the second cementing plug has a same configuration as the first cementing plug. The second cementing plug is forced downhole. Because the second cementing plug creates a fluid-tight seal to the inner circumference of the casing, as the second cementing plug moves downhole, the second cementing plug forces cement slurry remaining in the casing downhole and through the tube that penetrated the first cementing plug. The second cementing plug also acts to scrape cement slurry remaining on the inner surface of the casing. Eventually, the second cementing plug may reach, and come into contact with, the first cementing plug. At that point, downhole movement of the second cementing plug stops.

The first cementing plug, the second cementing plug, and the tool at the landing collar are all made of materials that can be drilled-through, such as aluminum, lead, or elastomer. After the cement slurry hardens, a drill bit is moved into the wellbore and is operated to drill through the first cementing plug, the second cementing plug, and the tool at the landing collar. Examples of drill bits that may be used include polycrystalline diamond material drill bits and tricone drill bits.

The example system may also include environmental sensors such as pressure sensors located both uphole of the first cementing plug and downhole of the first cementing plug, for example. Data from the sensors may represent pressure readings uphole of the first cementing plug and downhole of the first cementing plug. This data may be transmitted wirelessly to a control system that may be located at the surface or downhole. The control system may be configured—for example, programmed—to process the data to obtain information about the cementing operation. For example, the information may indicate whether the cement slurry is contaminated. The information may relate to a sealing integrity of the first cementing plug to the casing. The information also may be used to improve a design of the system, to detect leaks in the system, or to detect a pressure or force used to shear, to break, to rupture, or to pierce part of the first cementing plug.

FIG. 1 shows an example implementation of a casing string 10. The example of FIG. 1 includes surface casing 11 that reaches to surface 12, intermediate casing 13 that reaches to surface 12, and production casing 14 that reaches to surface 12. Although three casings are included in the casing string of FIG. 1, a casing string may include any number of casings, such as four, five, or six casings. In some implementations, the casing string also includes tools (not labeled), such as wellheads and hangers that are configured to suspend, to seal, and to support downhole casings. In an example, a hanger suspends downhole casings and includes a sealing system to ensure that the annular space between casings hydraulically isolates casings from one another.

Figure 4:
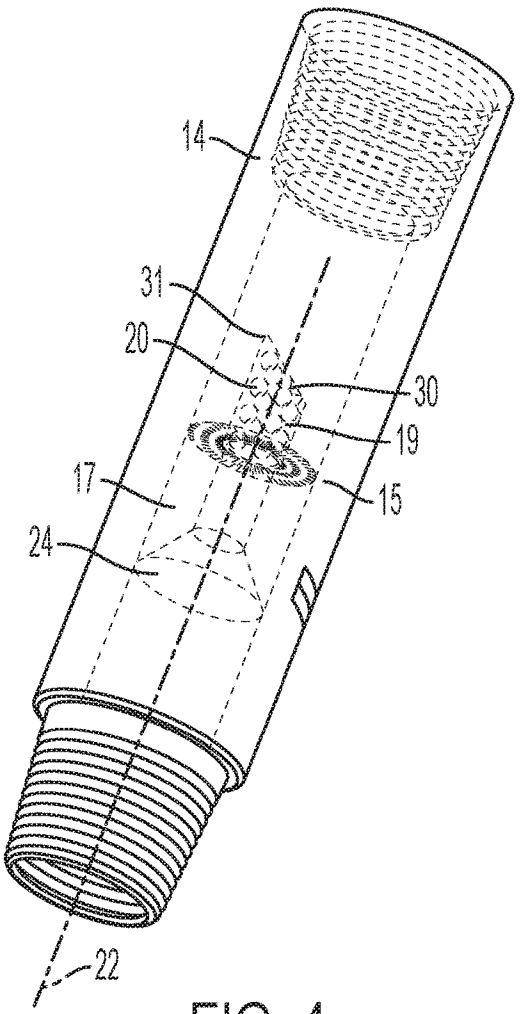
FIG. 4 is a perspective view of the example tool for penetrating the cementing plug within the casing.
Figure 2:
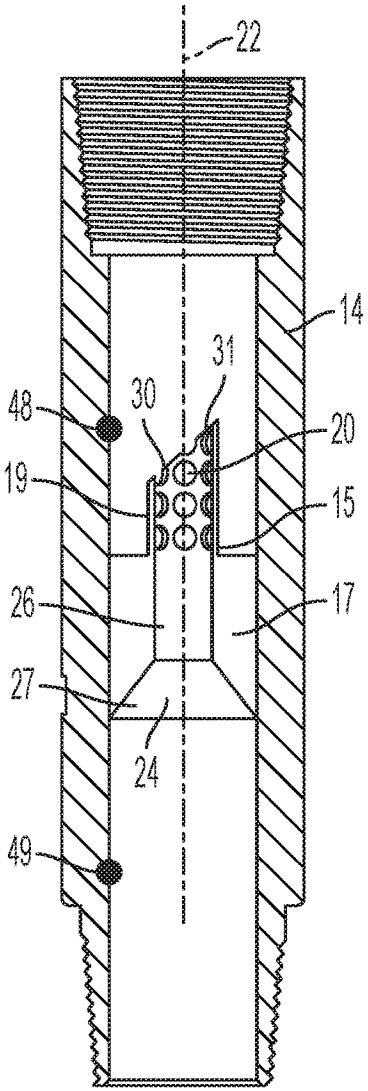
FIG. 2 is a cut-away side view of an example tool within a casing for penetrating a cementing plug within the casing.

A casing such as casing 14 may include a landing collar (not shown). The landing collar includes a stopper that is located at or near to the end of the casing and that prevents further movement of a cementing plug within the casing. The end of the casing may include the part of the casing that is adjacent to an exposed formation. In some implementations, a tool 15 such as that shown in FIGS. 2, 3, and 4 may be located at the landing collar. In some implementations, the tool may be located uphole of the landing collar and fixed into position against the casing.

Figure 3:
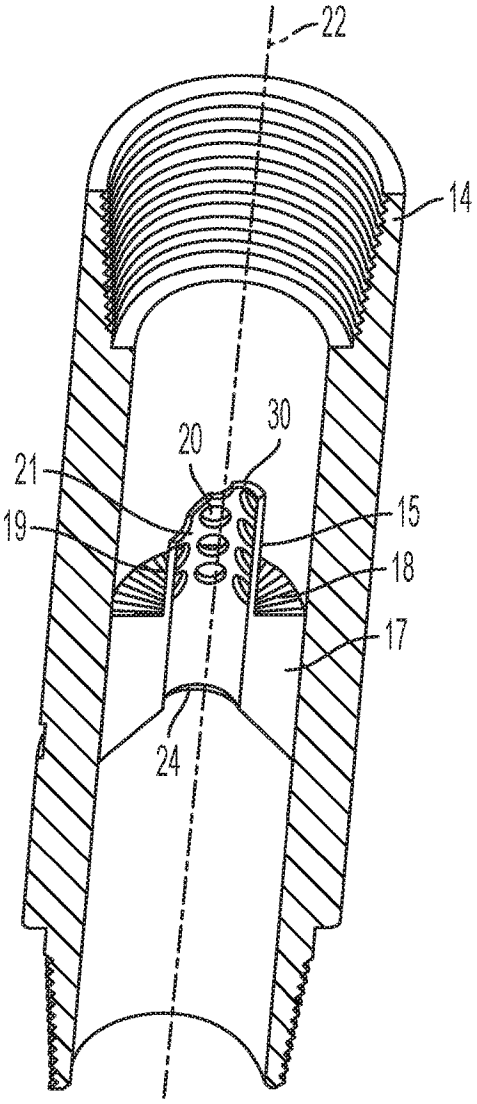
FIG. 3 is a cut-away perspective view of the example tool within the casing for penetrating the cementing plug within the casing.

In this example, tool 15 is configured for installation on the landing collar of casing 14. To this end, tool 15 includes a base 17 that conforms to an inner circumference of the casing and a needle-shaped tube 19 that extends uphole from the base. In an example, the needle-shaped tube has a diameter of 1.2 inches (30.48 millimeters (mm)). Tube 19 is perforated in that it includes holes 20 along its circumference and length. The holes may all have the same diameters or different holes may have different diameters. In an example, all or some of these holes have a diameter of one inch (25.4 mm). In this example, holes 20 also extend along a length of at least part of the tube. The length here is along longitudinal axis 22. In some implementations, the tool does not include holes, but only opening 21 (FIG. 3).

Tool 15 includes a central borehole 24 that extends downhole along its entire length and through the base. In other words, the borehole extends through the entirety of tool 15 to create a pathway for cement slurry to pass from a point in the casing uphole of the tool to a point downhole of the tool. The holes 20 in the tube facilitate the passage of the cement slurry in that the holes provide entry points for the cement slurry in addition to the opening 21 at the top of the tube.

In this example, central borehole 24 is funnel-shaped. In this example, a first part 26 of the borehole adjacent to holes 20 in tube 19 is the narrow part of the funnel shape. In this example, a second part 27 of the borehole within base 17 is a wider part of the funnel shape. Tool 15, however, is not limited to use with a funnel-shaped borehole. For example, the borehole may be cylindrical along its entire length or the borehole may be more narrow downhole than it is uphole.

Figure 6:
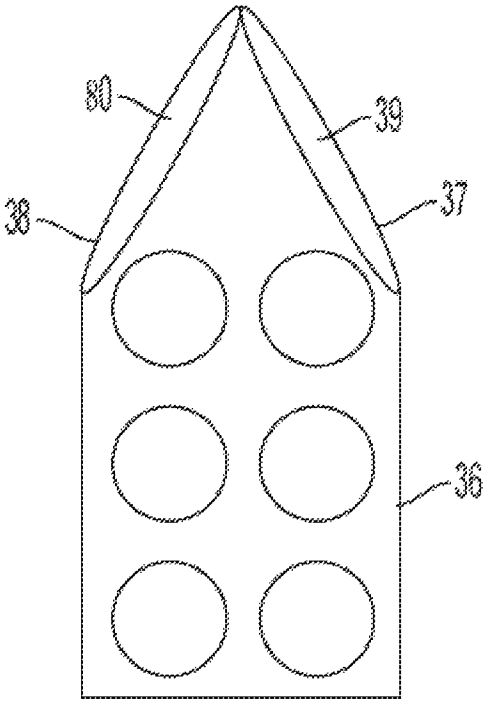
FIG. 6 is a side view of an example tube having a double-beveled edge that is part of the tool for penetrating the cementing plug.
Figure 5:
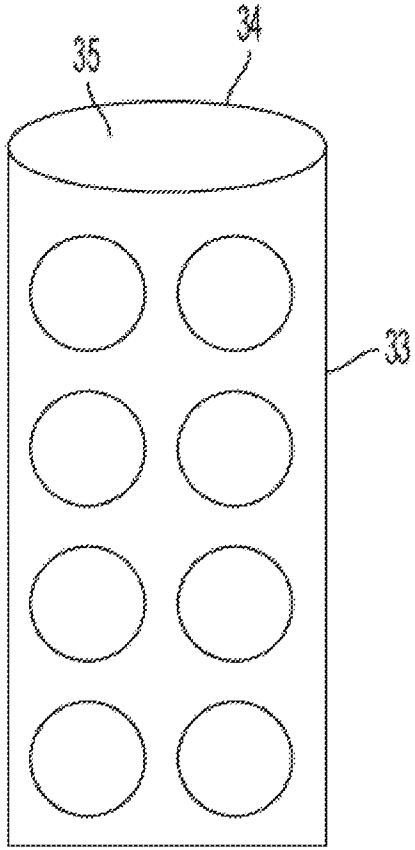
FIG. 5 is a side view of an example tube having a horizontal edge that is part of the tool for penetrating the cementing plug.

In this example, tube 19 is needle-shaped. In some implementations, a needle-shaped tube has an opening 21 that is formed by a beveled edge 30. The beveled edge 30 that forms the opening ends in a pointed tip 31. This pointed tip is used to shear, to break, to rupture, or to pierce part of a cementing plug as described subsequently. In some implementations, other needle-shaped or non-needle-shaped tubes may be used. For example, a tube 33 may have a horizontal edge 34 that forms an opening 35 as shown in FIG. 5. For example, a tube 36 may be formed by an intersection of two or more beveled edges 37 and 38 that correspond to openings 39 and 80, respectively, as shown in FIG. 6.

Tool 15 and cementing plugs remain in the casing following cementing. Accordingly, the tool and cementing plugs may be made of any material that can be drilled through using a drill bit. In some implementations, tool 15 is made of or includes aluminum, lead, or a combination of aluminum and lead. Examples of drill bits that may be used to drill through the tool and the cementing plugs include polycrystalline diamond material drill bits and tricone drill bits.

Figure 7:
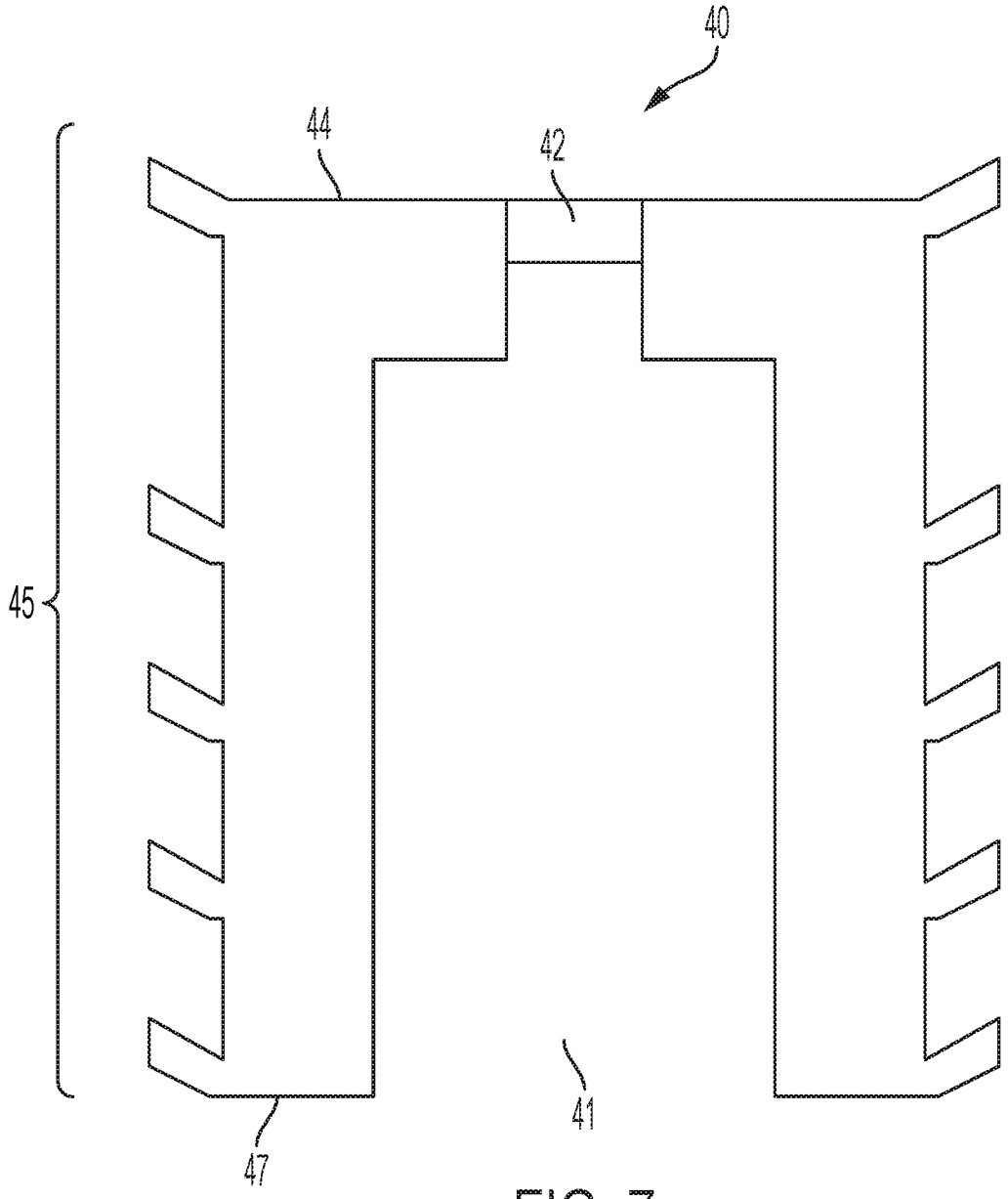
FIG. 7 is a side view of an example cementing plug.

FIG. 7 shows an example cementing plug 40 that may be used during a cementing operation performed on casing 14. Cementing plug 40 may be made of rubber or other malleable materials that can create a fluid-tight—for example, a liquid-tight and air-tight—seal to the inner circumference of the casing. For example, cementing plug 40 may be made of an elastomer, aluminum, or a combination of an elastomer and aluminum. Cementing plug 40 is configured—for example, shaped and arranged—to create the fluid-tight seal to the casing uphole of tool 15. In this example, the fluid-tight seal separates the drilling fluid downhole of tool 15 from the cement slurry uphole of tool 15 and thereby isolates the drilling fluid from the cement slurry. As a result of this isolation, there is less chance that the cement slurry will be contaminated with other fluids.

Cementing plug 40 includes a cylindrical body in this example. The cylindrical body includes a center borehole 41 to receive tube 19 as described subsequently. Cementing plug 40 also includes a covering 42 that extends across at least part of center borehole 41 and that is configured to shear, to break, or to rupture in response to forcible contact with the tube. In some implementations, the covering extends across only part—that is, less than all—of the uphole portion 44 of the cementing plug. In some implementations, the covering includes a disk that is configured to break in response to contact with the tube at a sufficient force. The disk may be configured to withstand pressure higher than a maximum circulating pressure during cementing and lower than a burst pressure for the casing. The covering may be made of ceramic or aluminum, for example. In some implementations, the covering has a thickness of one inch (25.4 mm). The covering may also be configured—for example, shaped, arranged, or composed—to break in response to hydraulic pressure within a range of 500 pounds-per-square-inch (PSI) (3447.38 kilopascals (kPa) to 10,000 PSI (68,974.57 kPa). So, for example, if the tube does not break the covering, sufficient pressure applied to the covering by the cement slurry will cause the covering to break. The hydraulic pressure thus acts a backup or secondary activation system for the cementing plug.

Cementing plug 40 also includes fins 45 on its exterior surface. The fins may extend completely around the circumference of the cementing plug and may be made of the same or different material as the cementing plug. For example, the fins may be made of elastomer, aluminum, or both. The fins come into contact with the inner circumference of the casing to create the fluid-tight seal between the cementing plug and the casing. The fins are also configured to scrape an inner surface of the casing as the cementing plug moves downhole. For example, for a first (or downhole) cementing plug, the fins may scrape the inner surface of the casing to remove residual drilling fluid or other solid and liquid materials from the casing. For example, for a second (or uphole) cementing plug, the fins may scrape the inner surface of the casing to remove residual cement slurry from the casing.

Cementing plug 40 also includes a bottom face 47 that contacts the tool. The bottom face may have a coarse surface to increase an amount of friction between the cementing plug and the tool. For example, the bottom face may have teeth (not shown in FIG. 7) to increase an amount of friction between the cementing plug and the base of the tool. Referring to FIG. 3, the part of base 17 that the cementing plug contacts may also include teeth 18 or a coarse surface to increase further the amount of friction between the cementing plug and the base. The increased amount of friction between the cementing plug and the tool may reduce the chances that the cementing plug will rotate while it is being drilled through following cementing. In some implementations, teeth or other protrusions on the face of the cementing plug may fit within grooves on the tool to thereby lock the cementing plug in place relative to the tool. This type of locking may also reduce the chances that the cementing plug will rotate while it is being drilled through following cementing.

Figure 8:
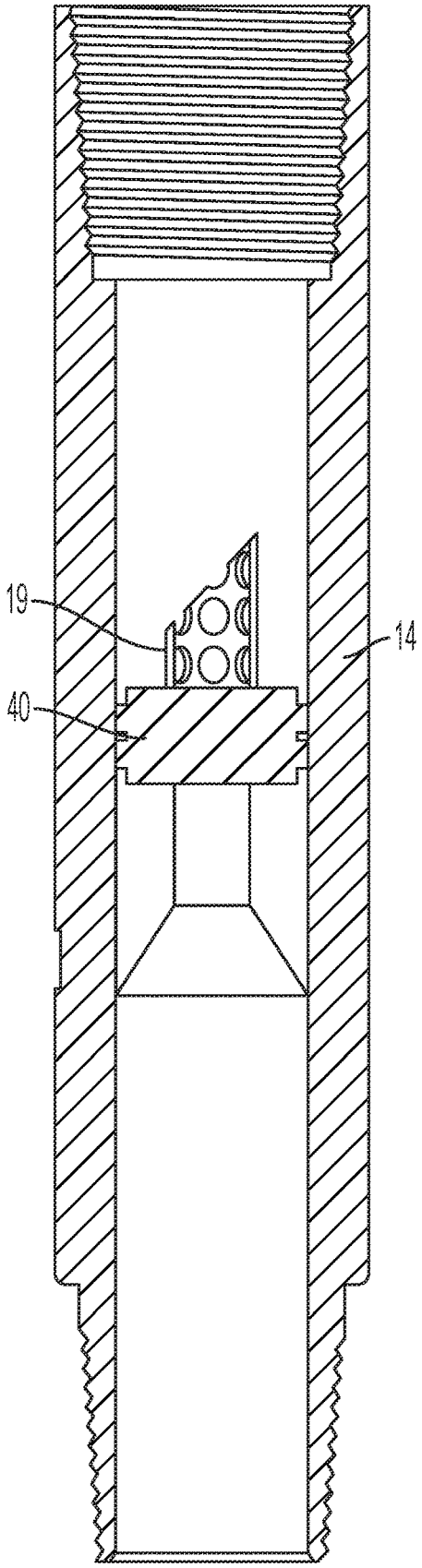
FIG. 8 is a cut-away side view of a part of a casing containing the example tool in contact with the example cementing plug.

The casing may include environmental sensors to sense environmental conditions within the wellbore. For example, the casing may include pressure sensors 48, 49 (see FIG. 2) to sense pressure within the wellbore. In some implementations, the casing may include two pressure sensors—one located uphole from tool 15 and one located downhole from tool 15. In some implementations, one pressure sensor may be located uphole of a landing collar joint and one pressure sensor may be located downhole of the landing collar joint. In some implementations, one pressure sensor may be located uphole of a connected tube/cementing plug combination and one pressure sensor may be located downhole of the connected tube/cementing plug combination. In this regard, as described subsequently, a cementing plug moves downhole and comes into contact forcibly with tool 15. The pointed tip of tube 19 penetrates the cementing plug. For example, the pointed tip of tube 19 breaks, shears, ruptures, or pierces the covering, causing the tube 19 to extend through the cementing plug 40 as shown in FIG. 8. The tube and cementing plug thus form a connected tube/cementing plug combination. In some implementations, the pressure sensors may be arranged on or within the walls of the casing, a tubular hanger, or any other structure within the wellbore. Signals from these pressure sensors may be sent to the control system wirelessly or over wired connections.

In some implementations, the environmental sensors may include temperature sensors. In some implementations, one temperature sensor may be located uphole of a connected tube/cementing plug combination and one temperature sensor may be located downhole of the connected tube/cementing plug combination. Signals from these temperature sensors may be sent to the control system wirelessly or over wired connections.

The control system may be or include a computing system 23, as shown in FIG. 1. All or part of the computing system may be located on the surface or downhole. Communications between the sensors and the computing system are represented by arrow 50. For example, readings from the sensors may be sent to the computing system in real-time or the computing system may query the sensors for readings or other information. In this regard, real-time may include actions that occur on a continuous basis or track each other in time taking into account delays associated with processing, data transmission, and hardware.

The computing system may be configured—for example, programmed, connected, or both programmed and connected—to control operations, such as drilling and cementing, to form or to extend a well. For example, a drilling engineer may input commands to the computing system to control such operations. In response to these commands, the computing system may control hydraulics, electronics, or motors that control, for example, operation of the drill string or operation of one or more pumps to move drilling fluid and cement slurry into a casing in the wellbore at appropriate times. Examples of computing systems that may be used are described in this specification.

Signals containing data may be exchanged between the computing system, the environmental sensors, and other wellbore components via wired or wireless connections. For example, there may be a wired or wireless network connection between the pressure sensors and the computing system. For example, the signals may be sent over a wired data bus that is not part of a network or using radio frequency (RF) signals that are not part of a wireless network. To implement wireless communication, each sensor may include a wireless transmitter or be connected to transmit data over a wireless transmitter. Each sensor may include a wireless receiver or be connected to receive data over a wireless receiver in order to receive information, such as queries, from the computing system. For example, rather than sending data automatically, each sensor may be queried by the computing system for data based on its readings.

The computing system may be configured to process data from the environmental sensors to obtain information about the cementing operation. For example, the information may indicate whether the cement slurry is contaminated or in a solid state. The information may relate to a sealing integrity of a cementing plug to the casing. The information also may be used to improve a design of the casing system, to detect leaks in the system, or to detect a pressure or force used to penetrate part of the first cementing plug, such as its disk.

In an example, each pressure sensor obtains pressure measurements over successive increments of time. When the covering breaks, the pressure uphole of the tool may decrease rapidly. The control system generates a graph of pressure versus time for each pressure sensor. Each graph is then compared to software-based simulations indicating when the covering is expected to break. If it takes less pressures to break the covering than in the software simulation, this means that the covering should be thicker or made of stronger material. If there is a leak during casing pressure testing, the pressure will drop uphole of the tool. If pressure drops uphole of the tool and there is a constant pressure downhole of the tool, the leak is determined to be above the tube/cementing plug combination. This may prompt a change in the design of the cementing plug to create a cementing plug that provides a stronger seal or that includes additional fins. Thus, the data from the pressure sensors may be useful in improving the design of the cementing plug.

In an example, each pressure sensor sends its pressure data to the control system. The control system analyzes the pressure data to determine when the covering breaks, which is identified by a rapid drop in pressure in the uphole pressure sensor. A drop in pressure detected by the uphole pressure sensor, the downhole pressure sensor, or both the uphole pressure sensor and the downhole pressure sensor may also indicate that there is a leak in the casing or that the integrity of the seal created by the cementing plug has been compromised. For example, a drop in pressure uphole or downhole of the tool/cementing plug combination may be compared to an expected drop in pressure when the covering breaks. If the pressure uphole or downhole is less than an expected pressure uphole or downhole, but is not within range of the expected pressure drop when the covering breaks, then this may be an indication of a leak or compromised seal integrity. For example, if the pressure drop is 5%, 10%, 15%, or 20% of the expected drop in pressure when the covering breaks, then this may be an indication that there is a leak or the seal integrity is compromised.

In some implementations, the control system uses pressure data from the sensors to determine whether the cement slurry has been contaminated with fluid, such as drilling fluid. For example, data from the pressure sensors may be used to determine the equivalent circulation density (ECD) of each fluid phase during cementing. ECD includes the dynamic density exerted by drilling fluid downhole.

Cement slurry has different fluid properties from other fluids located downhole. In some implementations, the system uses the pressure sensors to transmit pressure values measured during cementing. Using the pressure values from the sensors, the system can determine the ECD of fluid at locations downhole, including around the pressure sensors. In an example, Table 1 shows the pumping schedule during a cementing operation. In this example, the drilling fluid is pumped downhole at 80 pounds-per-cubit foot (pcf or lb/ft$^3$), a spacing fluid is pumped downhole at 100 pcf, and cement slurry is pumped downhole at 118 pcf. The downhole pressure sensors identify the ECD downhole during pumping. Different types of fluids have different ECDs. So, by determining the ECD, the type of fluid downhole can be determined. Furthermore, channeling between different fluids can be determined based on changes in the ECD values. This channeling can be evidence of contamination in the cement slurry.

TABLE

| FLUID TYPE | VOLUME (BARRELS - BBLS) | PUMP RATE (BBL/MINUTE (MIN)) |
|---|---|---|
| 100 pcf (spacing fluid) [1601.8 kilograms-per-cubic meter] | 150 | 7 |
| 118 pcf (cement slurry) [1890.2 kilograms-per-cubic meter] | 800 | 5 |

TABLE-continued

| FLUID TYPE | VOLUME (BARRELS - BBLS) | PUMP RATE (BBL/MINUTE (MIN)) |
|---|---|---|
| 100 pcf (spacing fluid) [1601.8 kilograms-per-cubic meter] | 50 | 5 |
| 80 pcf (drilling fluid) [1281.5 kilograms-per-cubic meter] | 1900 | 10 |

Figure 9:
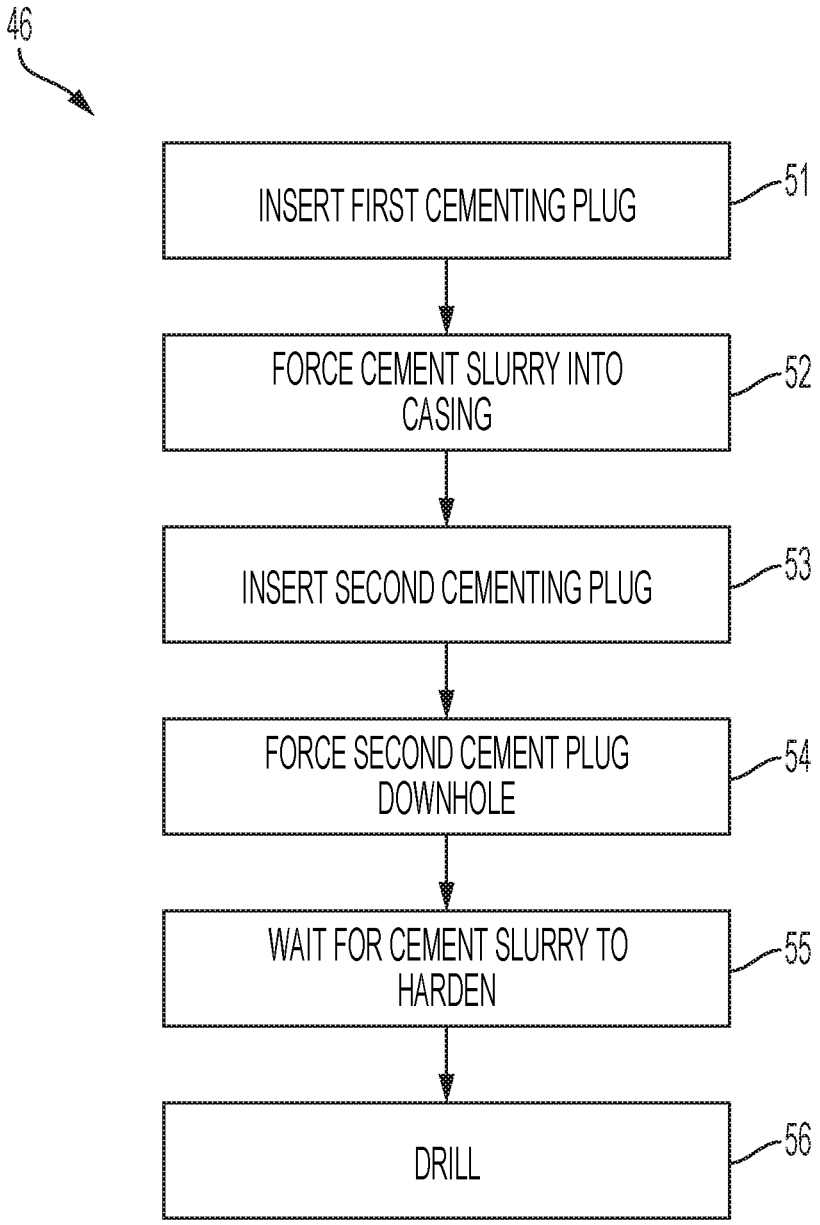
FIG. 9 is a flowchart showing an example cementing process that uses the example tool and the example cementing plug.

FIG. 9 shows operations included in example cementing process 46. FIGS. 10 through 14 illustrate the example cementing process of FIG. 9 graphically.

Figure 10:
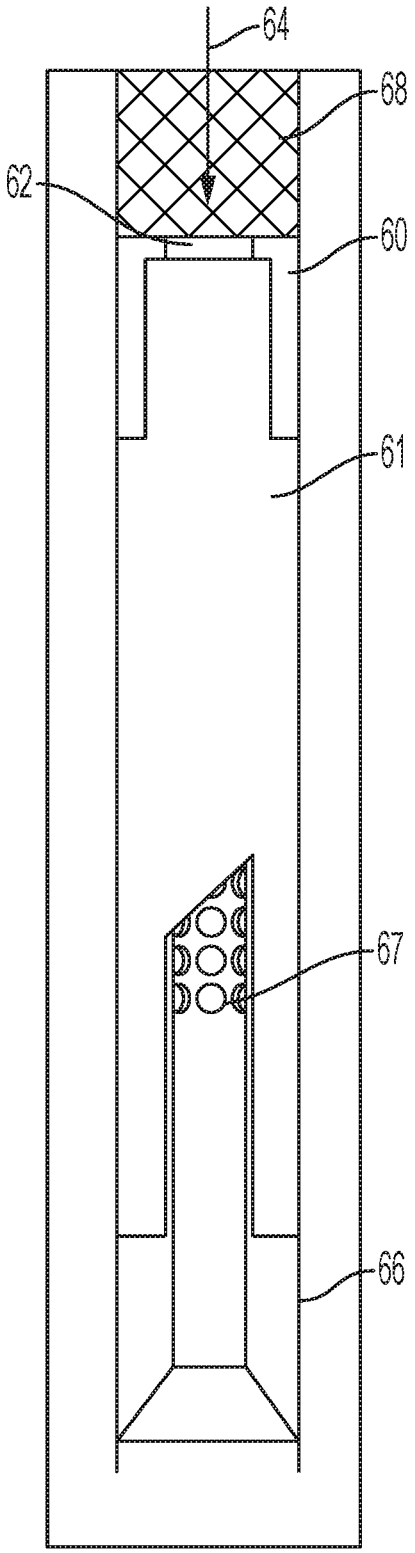
FIGS. 10, 11, 12, 13, and 14 each shows a cut-away side view of a part of a casing at a different instants in time during the example process of FIG. 9.
Figure 11:
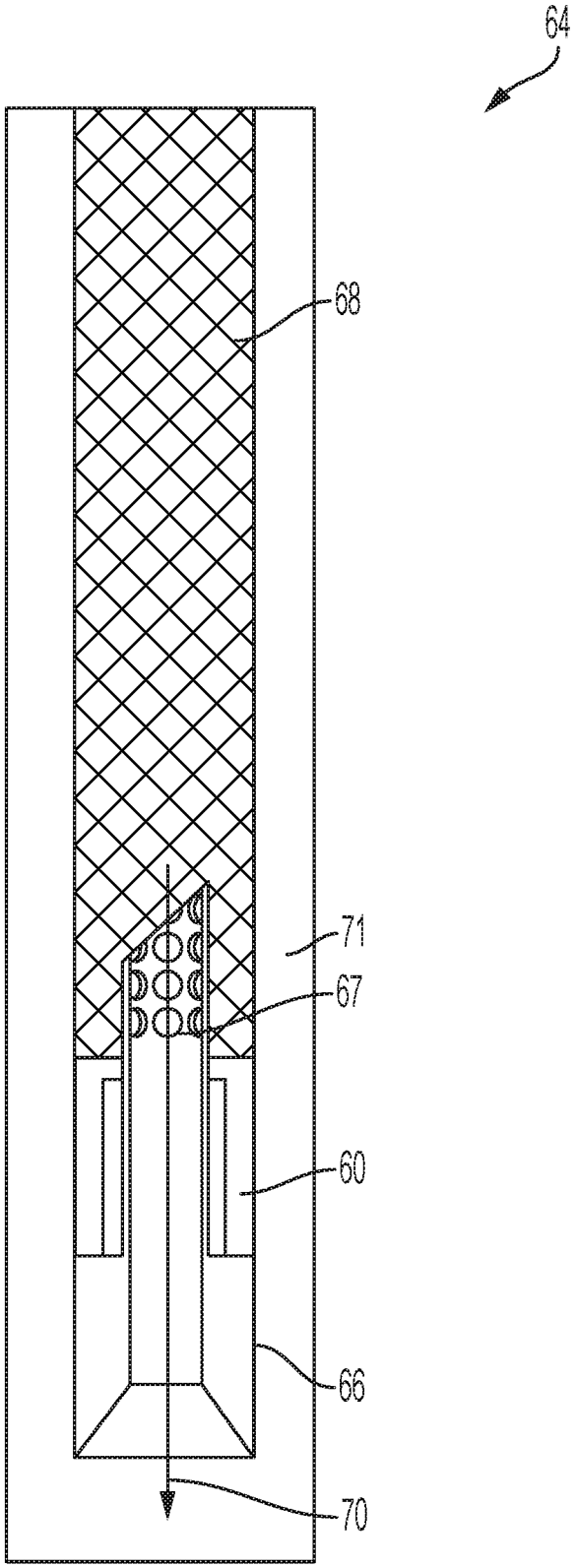
Figure 12:
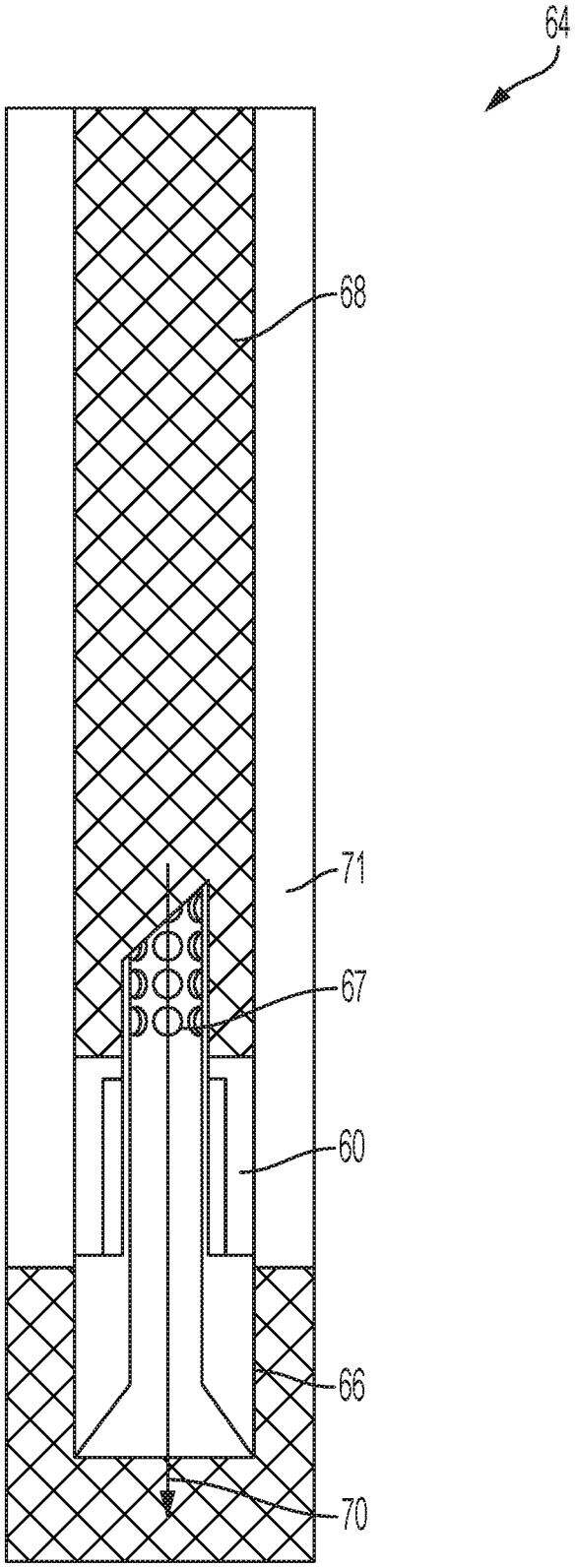

Referring initially to FIGS. 9 and 10, process 46 includes inserting (51) a first cementing plug 60 into a casing 61, which may have the configuration of casing 14 of FIG. 1. In this example, the first cementing plug has the configuration of cementing plug 40 of FIG. 7, including a covering 62 that breaks in response to forcible contact. Process 46 includes forcing (52) cement slurry 68 into the casing using pumps, for example. The forcing action is represented conceptually by arrow 64 in FIG. 10. A force of the cement slurry against the first cementing plug forces the cementing plug into contact with tool 66, which has the configuration of tool 15 of FIGS. 2, 3, and 4 in this example. Thus, tool 66 includes a needle-shaped tube 67 located at a landing collar within casing 61. Forcible contact between the first cementing plug 60 and the needle-shaped tube 67 causes the needle-shaped tube to penetrate the cementing plug. In this case, the contact between the first cementing plug 60 and the needle-shaped tube causes the needle-shaped tube to break the covering 62 on the cementing plug 60. The tube is longer than the cementing plug such that the tube extends through the cementing plug and beyond the cementing plug when the cementing plug contacts the base of the tool. Thus, tube 67 extends into cement slurry 68 as shown in FIG. 11. There may be a fluid tight seal between the tube and the covering. Downward force on the cement slurry causes the cement slurry to move through the holes and opening of tube 67 and into the borehole through the tool, as shown conceptually by arrow 70. Continued downward force on the cement slurry causes the cement slurry to move further downhole past the first cementing plug and into annulus 71 as shown in FIG. 12.

Figure 13:
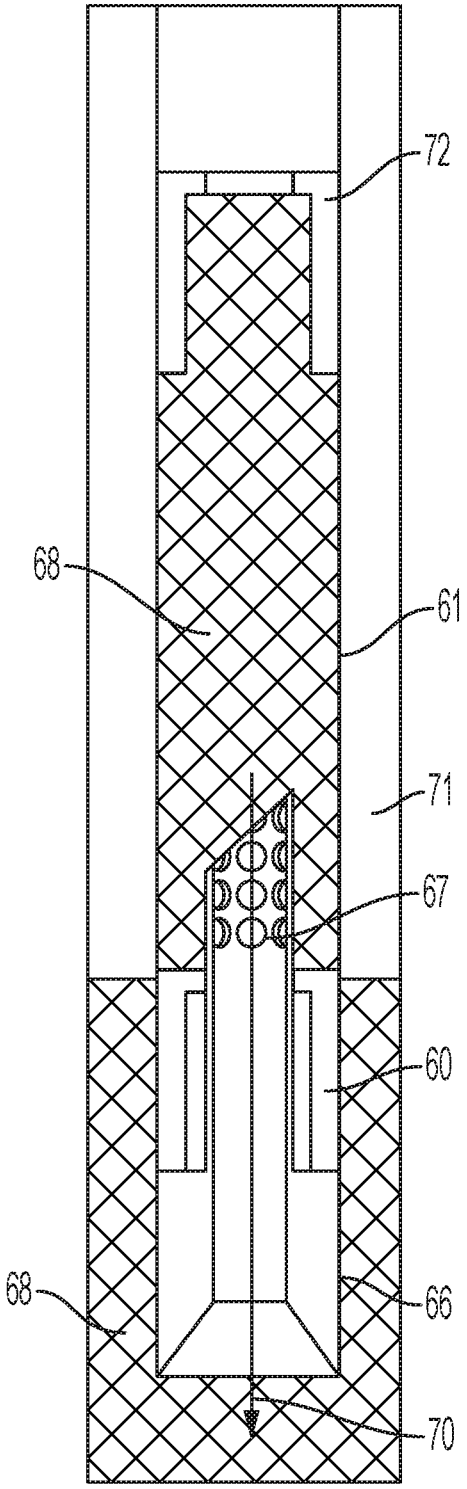
Figure 14:
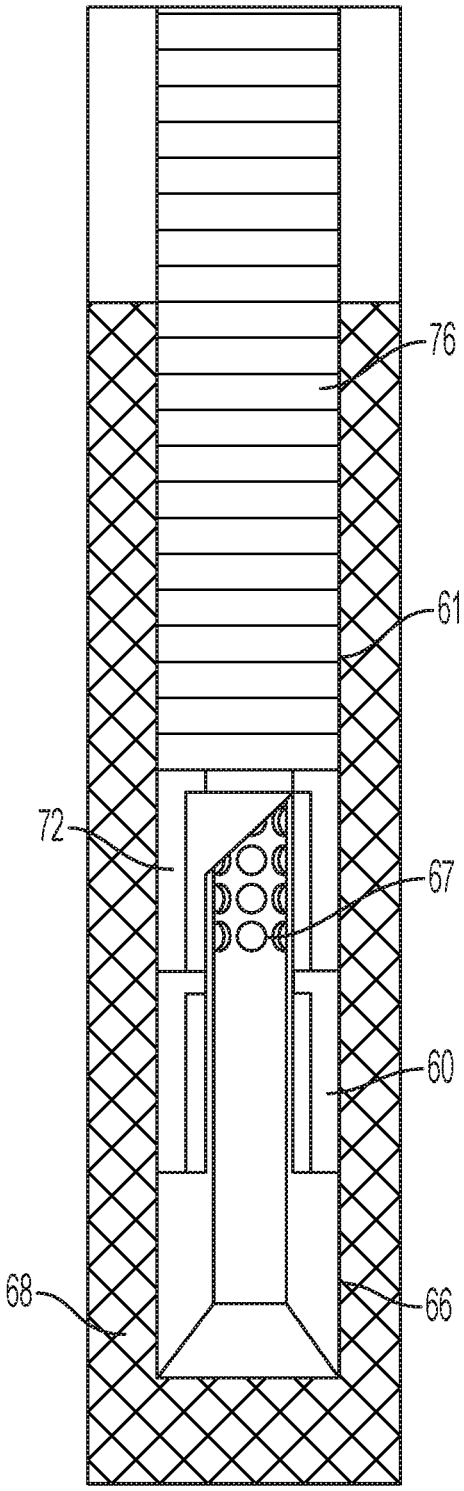

Referring to FIGS. 9 and 13, process 46 also includes inserting (53) a second cementing plug 72 into the casing 61 uphole of the cement slurry 68 and of the first cementing plug 60. In this example, the second cementing plug 72 has the configuration of cementing plug 40 of FIG. 7. However, in other examples, the second cementing plug may have a different configuration than cementing plug 40. For example, the second cementing plug may be solid—for example, solid rubber or aluminum. The second cementing plug is forced (54) downhole until the second cementing plug comes into contact with the first cementing plug, as shown in FIG. 14, for example. In this example, displacement fluid 76 such as drilling mud may be added uphole of the second cementing plug and pumped downhole to force the second cementing plug to move downhole. The force applied to the cement slurry 68 remaining in the casing by movement of the second cementing plug causes that cement slurry to pass through the first cementing plug via the needle-shaped tube and further into the annulus as shown in FIG. 14. Process 46 also includes waiting (55) for a period of hours or days for the cement slurry to harden. After that waiting period, a drill is inserted into casing 61 to drill (56) through the first cementing plug, the second cementing plug, and the needle-shaped tube within the casing.

During process 46, the control system obtains data from the pressure sensors uphole and downhole of the landing collar and processes the data to obtain information about the cementing process as described previously.

In some implementations, the cementing plug does not include a covering made out of a separate material than the rest of the cementing plug. Rather, needle-shaped tube may penetrate the cementing plug material.

Although vertical wellbores are shown and described in the examples presented in this specification, the example systems and methods described in this specification may be implemented in wellbores that are, in whole or part, non-vertical. For example, the systems and methods may be performed in deviated wellbores, horizontal wellbores, or partially horizontal wellbores. In some implementations, horizontal and vertical are defined relative to the Earth's surface.

All or part of the systems and methods described in this specification and their various modifications (subsequently referred to as "the systems") may be controlled at least in part by one or more computers using one or more computer programs tangibly embodied in one or more information carriers, such as in one or more non-transitory machine-readable storage media. A computer program can be written in any form of programming language, including compiled or interpreted languages, and it can be deployed in any form, including as a stand-alone program or as a module, part, subroutine, or other unit suitable for use in a computing environment. A computer program can be deployed to be executed on one computer or on multiple computers at one site or distributed across multiple sites and interconnected by a network.

Actions associated with controlling the systems can be performed by one or more programmable processors executing one or more computer programs to control all or some of the well formation operations described previously. All or part of the systems can be controlled by special purpose logic circuitry, such as, an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the systems described previously without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A system comprising:

a tool configured for installation on a landing collar of a casing, the tool comprising a base that conforms to an inner circumference of the casing and a tube that extends uphole from the base, the tube having a first borehole that extends downhole through the base, the tube being perforated to allow cement slurry to pass from the casing into the first borehole; and a cementing plug configured to seal to the casing uphole of the base, the cementing plug comprising a second borehole to receive the tube, the cementing plug comprising a covering that extends across at least part of the borehole and that is configured to break in response to contact with the tube, where the first borehole comprises a shape of a funnel, with a first part of the borehole adjacent to the perforations in the tube corresponding to a narrow part of the funnel, and where the first borehole comprises a second part of the borehole that is downhole of the first part of the borehole corresponding to a wide part of the funnel.

2. The system of claim 1, where the cementing plug comprises fins on an exterior surface of the cementing plug, the fins for contacting the inner circumference of the casing to seal the cementing plug to the casing.

3. The system of claim 1, where the cementing plug has a bottom face that contacts the base, the bottom face having a coarse surface to increase an amount of friction between the cementing plug and the base.

4. The system of claim 1, where the cementing plug has a bottom face that contacts the base, the bottom face having teeth to increase an amount of friction between the cementing plug and the base.

5. The system of claim 1, where the tube is longer than the cementing plug such that the tube extends through the cementing plug and beyond the cementing plug when the cementing plug is in contact with the base.

6. The system of claim 1, where the tube has a pointed tip for breaking the covering.

7. The system of claim 1, where the cementing plug is a first cementing plug; and where the system further comprises a second cementing plug configured to seal to the casing uphole of the first cementing plug, the second cementing plug having a same configuration as the first cementing plug.

8. The system of claim 1, where the covering comprises one of aluminum or ceramic.

9. The system of claim 1, where the tool comprises aluminum, lead, or a combination of aluminum and lead.

10. The system of claim 1, further comprising: pressure sensors, the pressure sensors comprising a first pressure sensor located uphole of at least part of the tool and a second pressure sensor located downhole of the tool.

11. The system of claim 10, further comprising:

a control system to obtain data from the pressure sensors and to process the data to determine when the covering breaks.

12. The system of claim 10, further comprising:

a control system to obtain data from the pressure sensors and to process the data to determine if a seal formed by the cementing plug has been compromised.

13. The system of claim 1, where the cementing plug comprises an elastomer or aluminum.

14. The system of claim 1, where the covering is configured to break also in response to hydraulic pressure within a range of 500 pounds-per-square-inch (PSI) (3447.38 kilopascals (kPa) to 10,000 PSI (68,974.57 kPa).

15. The system of claim 1, where the tube comprises a needle-shaped tube comprising an opening formed by the beveled edge, the beveled edge forming a pointed tip, and where the cementing plug comprises a disk configured to break in response to contact with the pointed tip of the needle-shaped tube.

16. The system of claim 1, where the tube comprises sets of holes along a circumference of the tube at various locations along a length of the tube, and where at least one hole of the sets of holes comprises a diameter of one inch.

17. The system of claim 1, where the tube comprises a needle-shaped tube, and where the needle-shaped tube comprises a diameter of 1.2 inches.

18. The system of claim 1, where the cementing plug is a first cementing plug; and where the system further comprises a second cementing plug configured to seal to the casing uphole of the first cementing plug, where the first cementing plug and the second cementing plug have different configurations.

* * * * *